US009747879B2

(12) United States Patent
Murata et al.

(10) Patent No.: US 9,747,879 B2
(45) Date of Patent: Aug. 29, 2017

(54) STORAGE MEDIUM, TONE GENERATION ASSIGNING APPARATUS AND TONE GENERATION ASSIGNING METHOD

(71) Applicant: Yamaha Corporation, Hamamatsu-Shi, Shizuoka-Ken (JP)

(72) Inventors: Eiji Murata, Hamamatsu (JP); Kyoko Ohno, Hamamatsu (JP); Naoki Yasuraoka, Hamamatsu (JP)

(73) Assignee: Yamaha Corporation, Hamamatsu-Shi (JP)

( * ) Notice: Subject to any disclaimer, the term of this patent is extended or adjusted under 35 U.S.C. 154(b) by 0 days.

(21) Appl. No.: 14/512,271

(22) Filed: Oct. 10, 2014

(65) Prior Publication Data

US 2015/0101476 A1 Apr. 16, 2015

(30) Foreign Application Priority Data

Oct. 12, 2013 (JP) ..... 2013-214280

(51) Int. Cl.
*G10H 1/00* (2006.01)
*G10H 1/18* (2006.01)
(Continued)

(52) U.S. Cl.
CPC ..... *G10H 1/186* (2013.01); *G10H 1/0025* (2013.01); *G10H 1/10* (2013.01); *G10H 1/22* (2013.01);
(Continued)

(58) Field of Classification Search
CPC ..... G10H 1/186; G10H 1/0025; G10H 1/10; G10H 1/22; G10H 1/386
(Continued)

(56) References Cited

U.S. PATENT DOCUMENTS 5,099,738 A 3/1992 Hotz
5,523,521 A 6/1996 Suzuki
(Continued)

FOREIGN PATENT DOCUMENTS

EP 2 866 222 A1 4/2015
FR 2 440 051 A1 5/1980
(Continued)

OTHER PUBLICATIONS

European Search Report dated Jun. 3, 2015, for EP Patent Application No. 14188459.3, eight pages.
(Continued)

*Primary Examiner* — Jianchun Qin
(74) *Attorney, Agent, or Firm* — Morrison & Foerster LLP

(57) ABSTRACT

When a harmony function is on state, a generator determines a chord based on one or more notes of depressed keys in a chord kea area, automatically generates one or more additional notes having pitches which harmonizes the pitch of the note of the depressed key in a performance key area according to the determined chord, and inputs the "note of the pressed key in the performance key area+additional notes" to an assignment controller. The assignment controller assigns plural parts (timbres) to the inputted notes, and sounds the notes in timbres of the plural parts according to the assignment. That is, tone generation assignment process is performed regarding not only notes according to performance operation by a user but also automatically generated additional notes.

13 Claims, 10 Drawing Sheets

(51) Int. Cl.

| | |
|---|---|
| ***G10H 1/38*** | (2006.01) |
| ***G10H 1/10*** | (2006.01) |
| ***G10H 1/22*** | (2006.01) |

(52) U.S. Cl.
CPC ..... *G10H 1/386* (2013.01); *G10H 2210/005* (2013.01); *G10H 2210/145* (2013.01); *G10H 2210/245* (2013.01); *G10H 2220/221* (2013.01); *G10H 2220/241* (2013.01); *G10H 2230/015* (2013.01); *G10H 2230/065* (2013.01); *G10H 2240/311* (2013.01)

(58) Field of Classification Search
USPC ..... 84/615
See application file for complete search history.

(56) References Cited

U.S. PATENT DOCUMENTS

| | | | | |
|---|---|---|---|---|
| 5,524,522 | A | 6/1996 | Hesnan | |
| 6,084,171 | A * | 7/2000 | Kay | G10H 1/38 84/613 |
| 6,791,568 | B2 | 9/2004 | Steinberg et al. | |
| 7,109,407 | B2 | 9/2006 | Hasegawa | |
| 7,212,213 | B2 | 5/2007 | Steinberg et al. | |
| 7,453,035 | B1 | 11/2008 | Evans et al. | |
| 7,608,775 | B1 | 10/2009 | Evans | |
| 7,767,895 | B2 | 8/2010 | Johnston | |
| 7,772,480 | B2 | 8/2010 | Brennan | |
| 7,842,877 | B2 | 11/2010 | Charles | |
| 7,982,118 | B1 | 7/2011 | Gleaves et al. | |
| 8,017,856 | B2 | 9/2011 | Tanaka | |
| 8,378,194 | B2 | 2/2013 | Daisy | |
| 8,957,296 | B2 | 2/2015 | Helms et al. | |
| 9,035,162 | B2 | 5/2015 | Hamilton et al. | |
| 9,129,583 | B2 | 9/2015 | Little et al. | |
| 2006/0032360 | A1 | 2/2006 | Mizuno | |
| 2007/0221047 | A1 | 9/2007 | Kim | |
| 2010/0077908 | A1 | 4/2010 | Tanaka | |
| 2010/0162875 | A1 | 7/2010 | Charles | |
| 2011/0023688 | A1 | 2/2011 | Daisy | |
| 2011/0232463 | A1 | 9/2011 | Sattlecker et al. | |
| 2013/0133506 | A1 | 5/2013 | Daisy | |
| 2014/0047971 | A1 | 2/2014 | Akazawa et al. | |
| 2015/0013529 | A1 | 1/2015 | Twillman | |
| 2015/0101474 | A1 | 4/2015 | Yasuraoka | |
| 2015/0107443 | A1 | 4/2015 | Yasuraoka | |
| 2015/0170624 | A1 | 6/2015 | Yamauchi et al. | |

FOREIGN PATENT DOCUMENTS

| | | | |
|---|---|---|---|
| JP | H-08-179771 | A | 7/1996 |
| JP | 2565069 | B2 | 12/1996 |
| JP | H-10-11063 | A | 1/1998 |
| JP | 2000-163059 | A | 6/2000 |
| JP | 2000-250533 | A | 9/2000 |
| JP | 2002-341871 | A | 11/2002 |
| JP | 2010-79179 | A | 4/2010 |
| WO | WO-90/07771 | A1 | 7/1990 |
| WO | WO-02/41295 | A1 | 5/2002 |
| WO | WO-2008/094415 | A2 | 8/2008 |
| WO | WO-2014/195584 | A1 | 12/2014 |

OTHER PUBLICATIONS

Roland. (Jan. 1, 1988). "MIDI Intelligent Synthesizer E-20," Owner's Manual, Osaka, Japan, Retrieved from Internet: <URL:http://media.rolandus.com/manuals/E-20OM.pdf> on May 26, 2014, 82 pages.

Anders, T. et al. (Oct. 18, 2011). "Constraint Programming Systems for Modeling Music Theories and Composition," ACM Computing Surveys, ACM, New York, NY, US, vol. 43, No. 4, Article 30, pp. 1-38, XP058004949, ISSN: 0360-0300, DOI: 10.1145/1978802.1978809.

European Communication dated Apr. 14, 2016, for EP Patent Application No. 14188459.3, eight pages.

European Office Action mailed Mar. 3, 2016, for EP Application No. 14188447.8, six pages.

Extended European Search Report mailed Mar. 30, 2015, for EP Application No. 14188447.8, nine pages.

Non-Final Office Action mailed Dec. 17, 2015, for U.S. Appl. No. 14/512,303, filed Oct. 10, 2014, seven pages.

Yamaha Corporation. (Jan. 2, 2012). "Digital Keyboard PSR-E343 YPT-340," Owner s Manual, C.S.G., DMI Development Division, located at: <URL:http://usa.yamaha.com/products/musical-instruments/keyboards/digitalkeyboards/portable_keyboards/psr-e343/>, retrieved on Mar. 5, 2015, pp. 1-64.

Final Office Action mailed Sep. 23, 2016, for U.S. Appl. No. 14/512,303, filed Oct. 10, 2014, seven pages.

Notice of Allowance mailed Mar. 1, 2017, for U.S. Appl. No. 14/512,303, filed Oct. 10, 2014, eight pages.

Notification of Reasons for Refusal dated Apr. 11, 2017, for JP Application No. 2013-214280, with English translation, five pages.

* cited by examiner

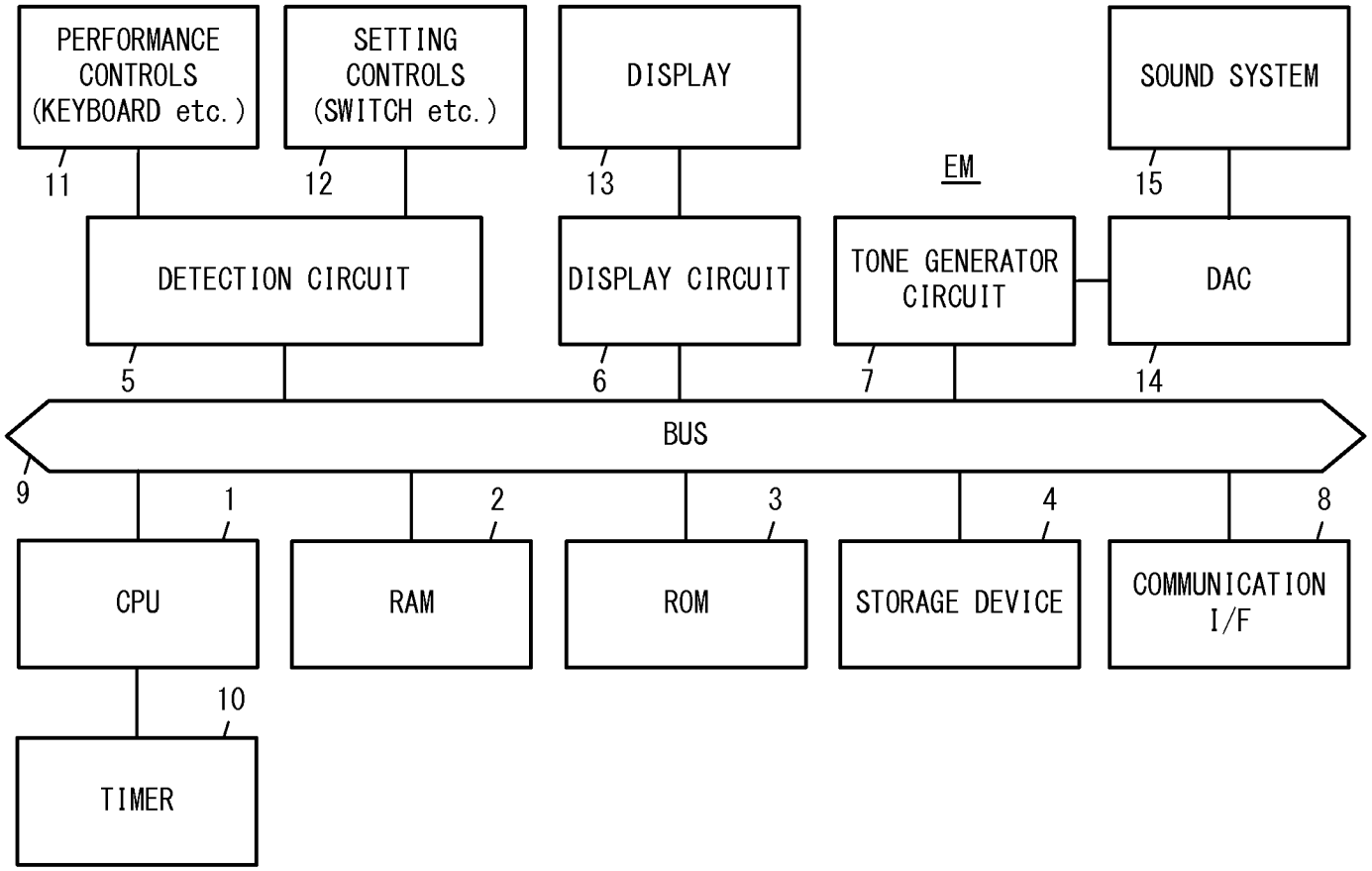
{Fig. 1}

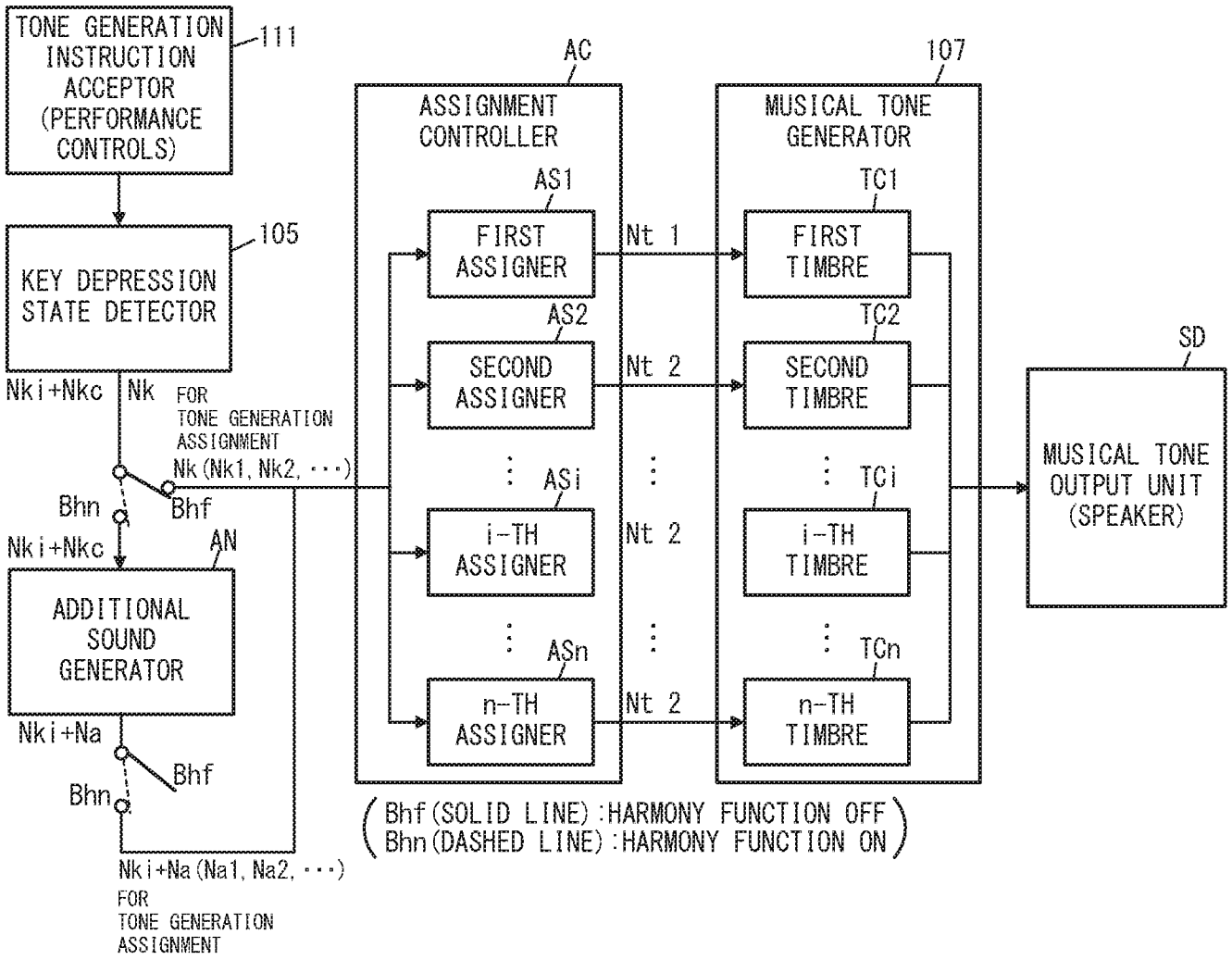
{Fig. 2}

{Fig. 3}
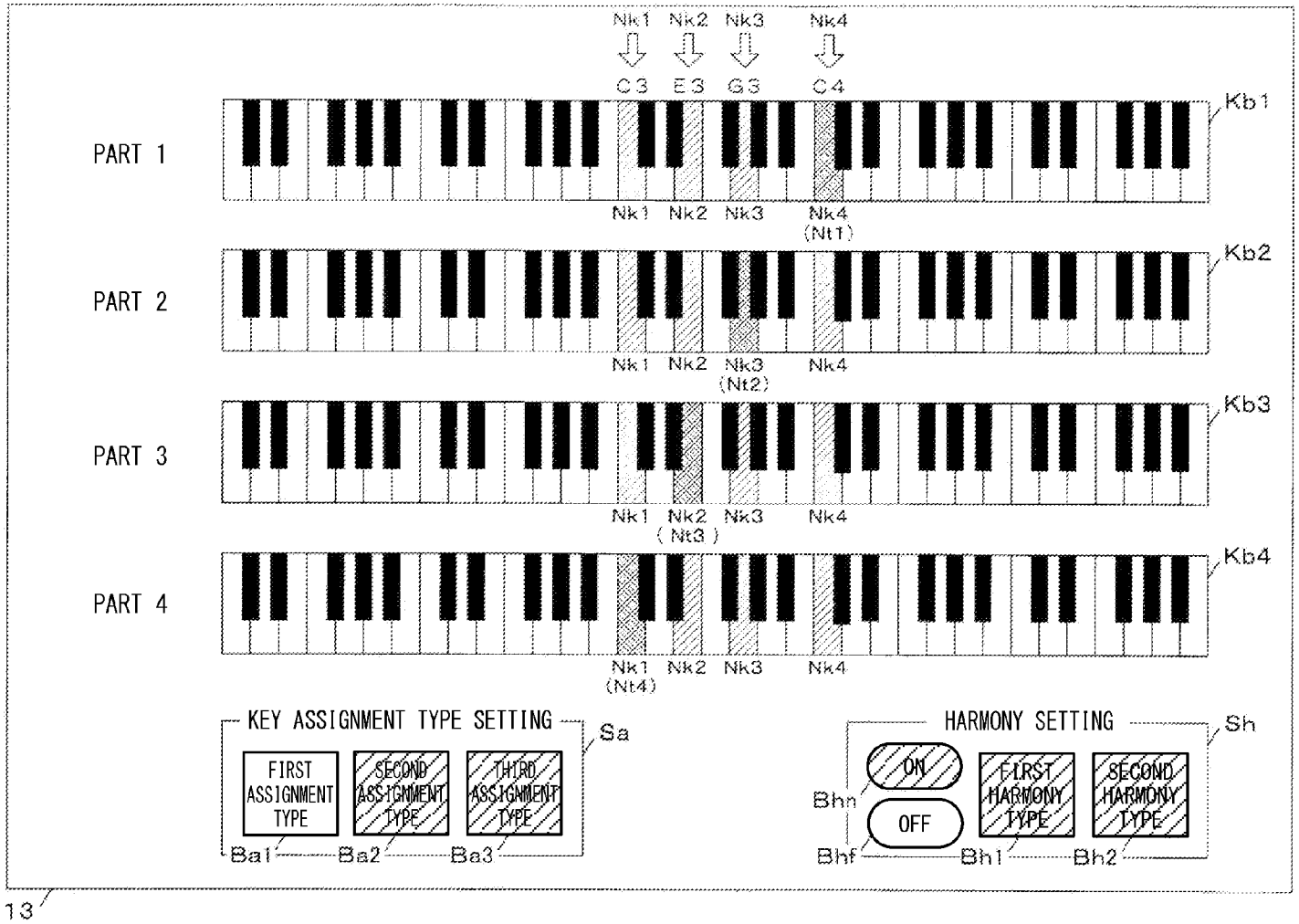

{Fig. 4}
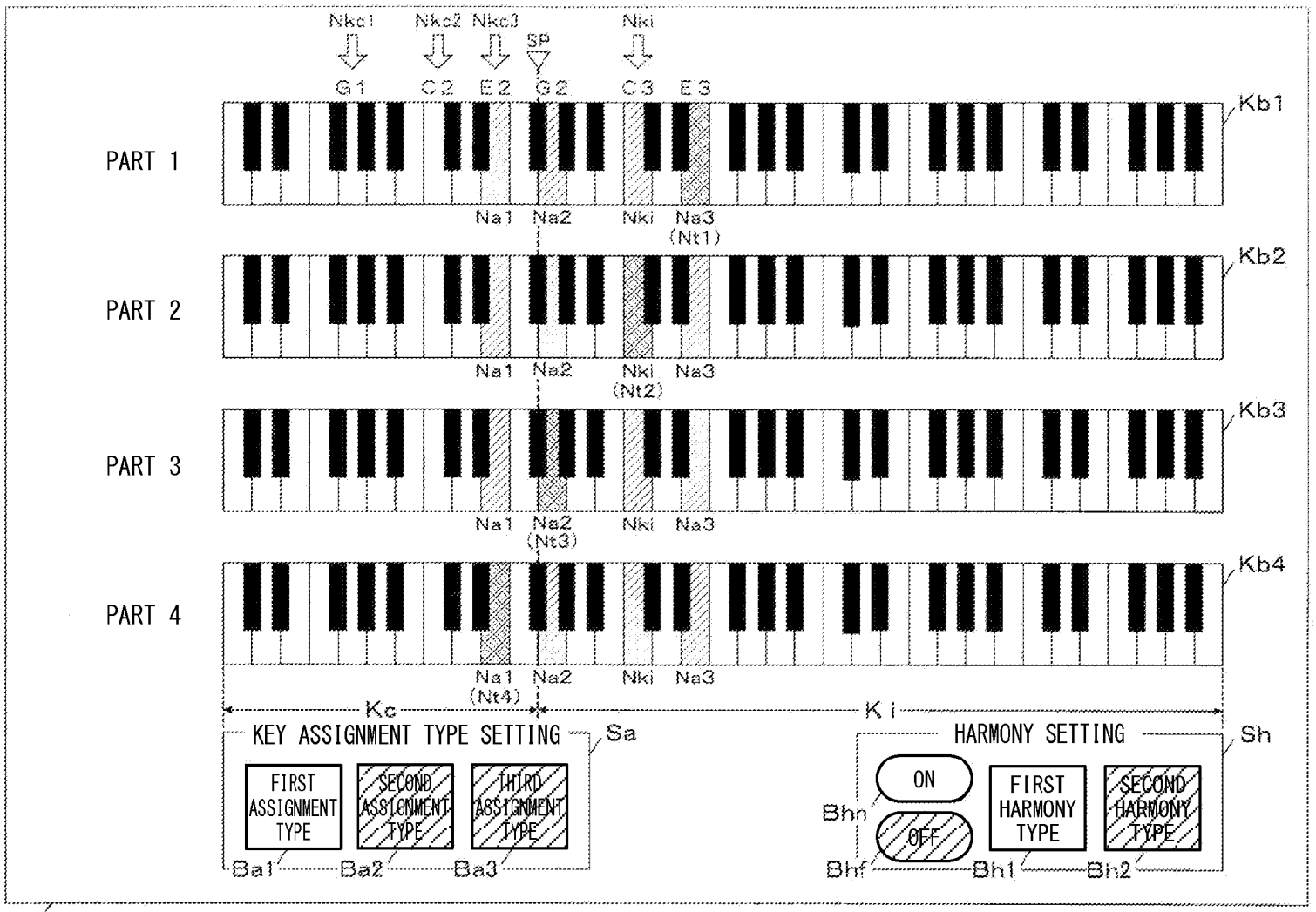

{Fig. 5A}
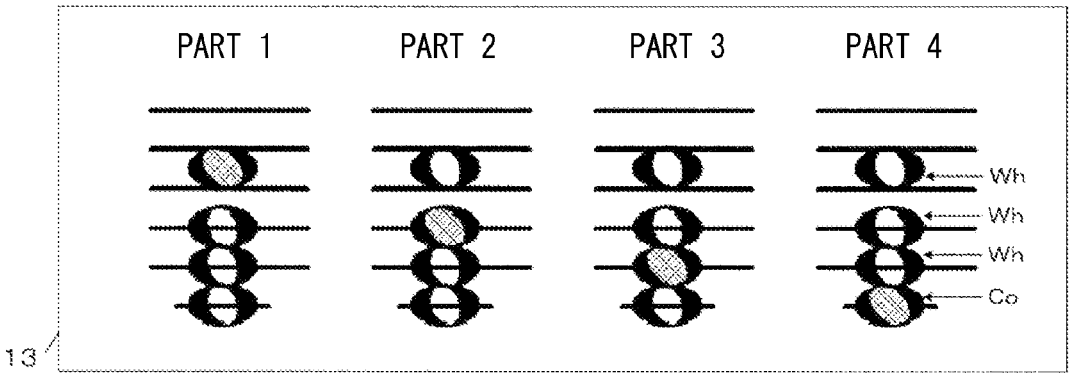
{Fig. 5B}
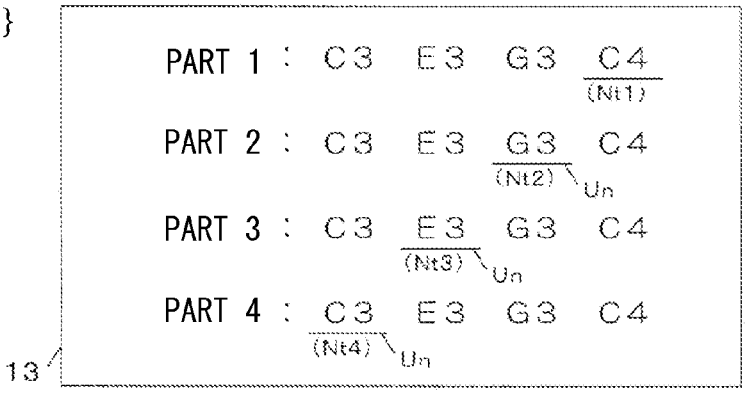
{Fig. 5C}
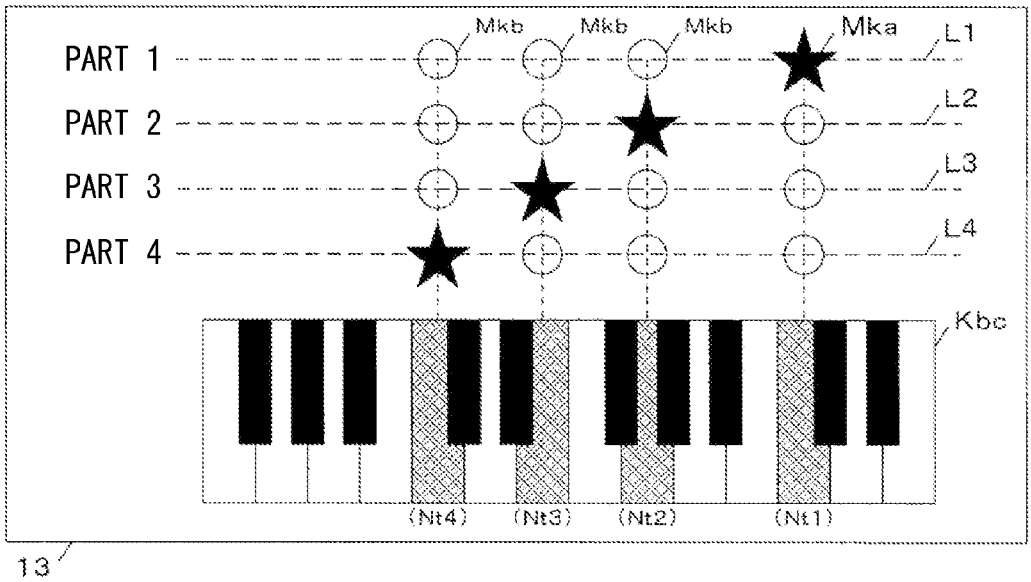

{Fig. 6A}

FIRST ASSINMENT TYPE

| | TARGET NOTE | PRIORITY METHOD | NUMBER TO BE SOUNDED |
|---|---|---|---|
| FIRST PART | ALL | HIGHER-PITCH-PRIOR-TO-LOWER-PITCH | 1 |
| SECOND PART | EXCLUDE HIGHEST PITCH | HIGHER-PITCH-PRIOR-TO-LOWER-PITCH | 1 |
| THIRD PART | UP TO TWO NOTES FROM LOWER PITCH SIDE | HIGHER-PITCH-PRIOR-TO-LOWER-PITCH | 1 |
| FOURTH PART | ALL | LOWER-PITCH-PRIOR-TO-HIGHER-PITCH | 1 |

{Fig. 6B}

SECOND ASSINMENT TYPE

| | FIRST TARGET NOTE | SECOND TARGET NOTE | NUMBER TO BE SOUNDED | NUMBER TO BE SOUNDED |
|---|---|---|---|---|
| FIRST PART | ALL | - | HIGHER-PITCH-PRIOR-TO-LOWER-PITCH | 1 |
| SECOND PART | EXCLUDE HIGHEST PITCH | UP TO TWO NOTES FROM HIGHER PITCH SIDE | LAST-NOTE-PRIOR-TO-FIRST-NOTE | 1 |
| THIRD PART | EXCLUDE LOWEST PITCH | UP TO TWO NOTES FROM LOWER PITCH SIDE | LAST-NOTE-PRIOR-TO-FIRST-NOTE | 1 |
| FOURTH PART | ALL | - | LOWER-PITCH-PRIOR-TO-HIGHER-PITCH | 1 |

{Fig. 6C}

THIRD ASSINMENT TYPE

| | NUMBER OF NOTES | | | |
|---|---|---|---|---|
| | 1 | 2 | 3 | 4 |
| FIRST PART | KEY DEPRESSION NOTE | HIGHEST NOTE | HIGHEST NOTE | HIGHEST NOTE |
| SECOND PART | KEY DEPRESSION NOTE | HIGHEST NOTE | SECOND HIGHEST NOTE | SECOND HIGHEST NOTE |
| THIRD PART | KEY DEPRESSION NOTE | LOWEST NOTE | LOWEST NOTE | SECOND LOWEST NOTE |
| FOURTH PART | KEY DEPRESSION NOTE | LOWEST NOTE | LOWEST NOTE | LOWEST NOTE |

{Fig. 7}
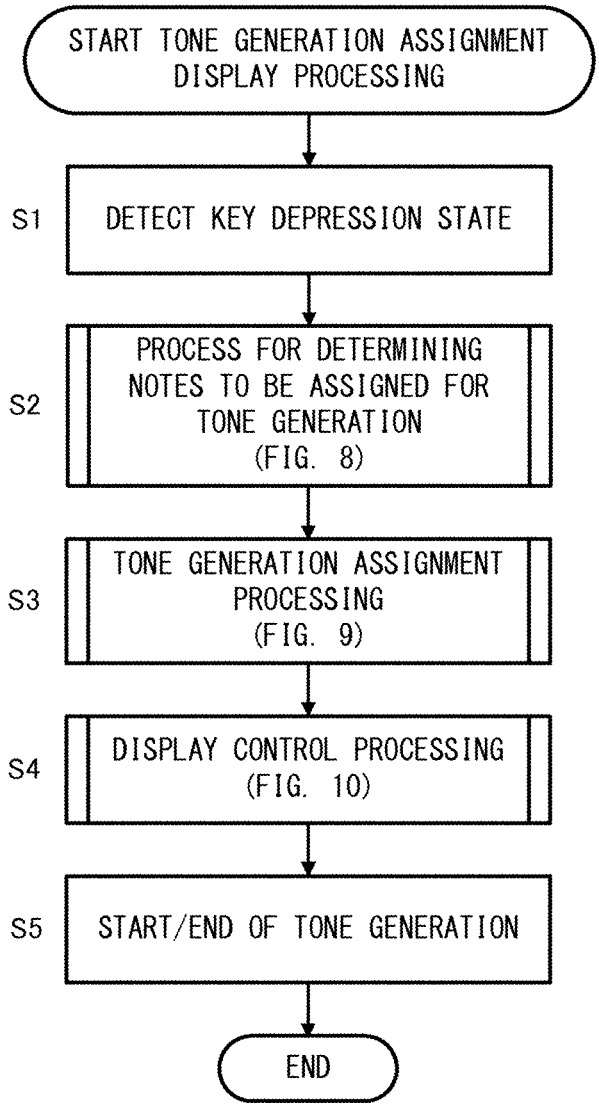

{Fig. 8}
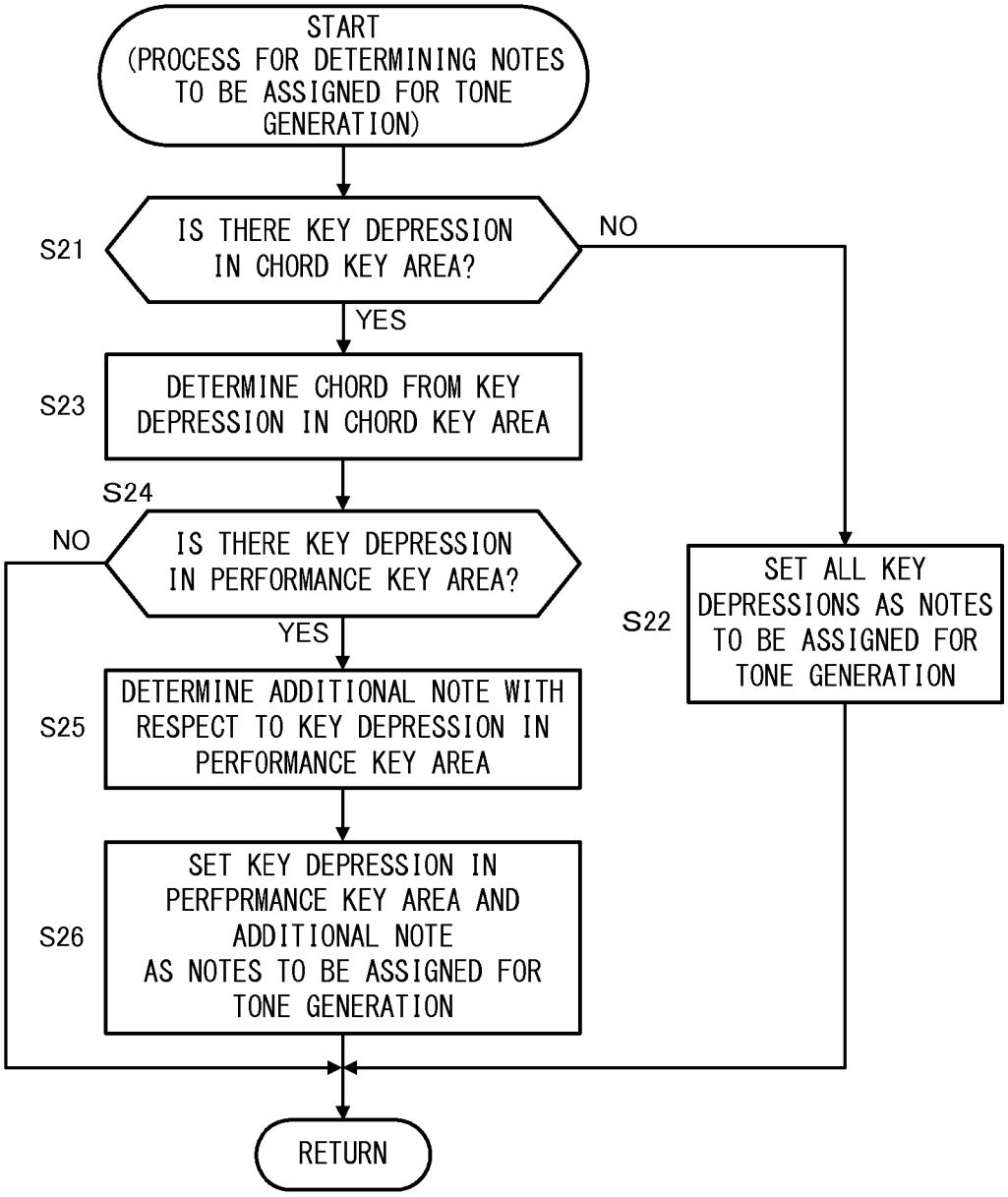

{Fig. 9}
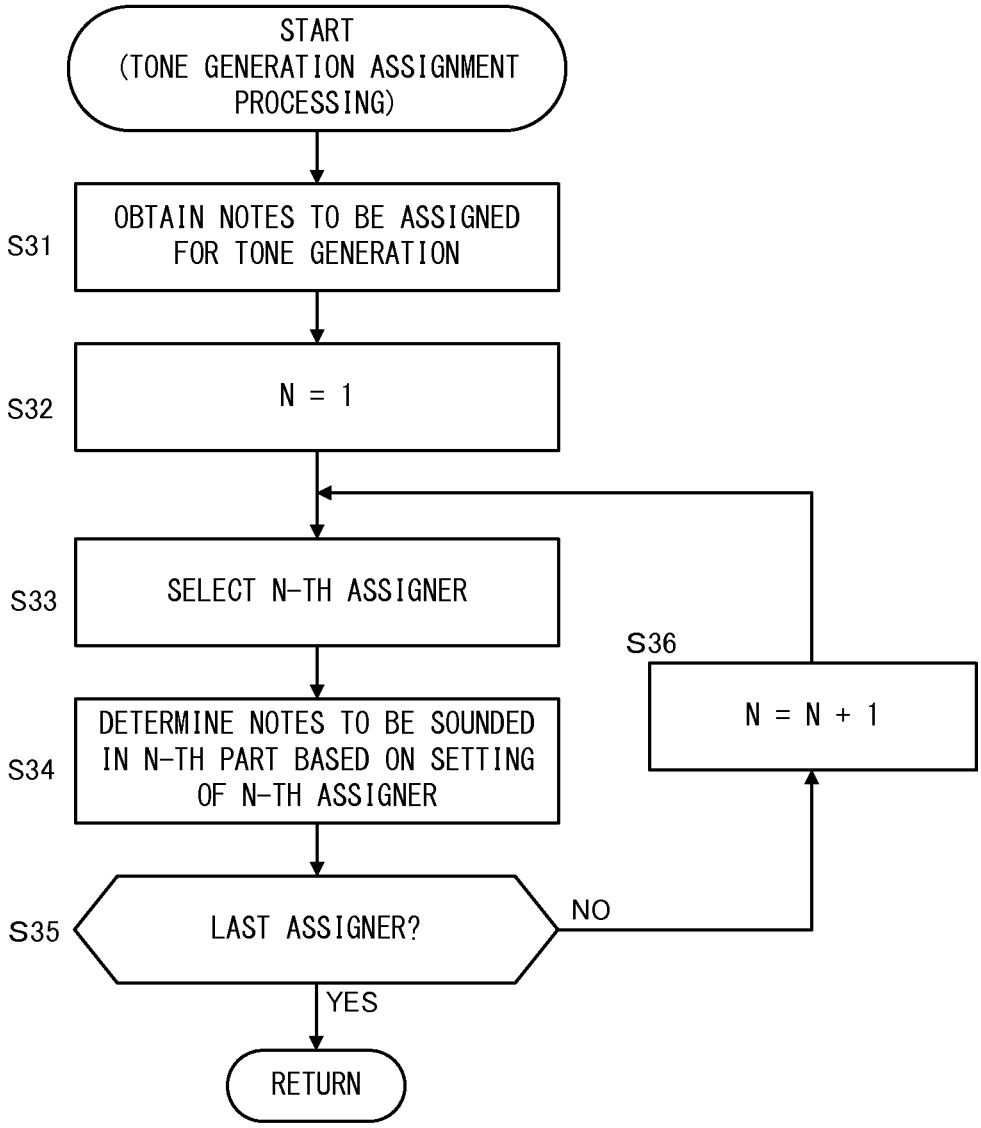

{Fig. 10}
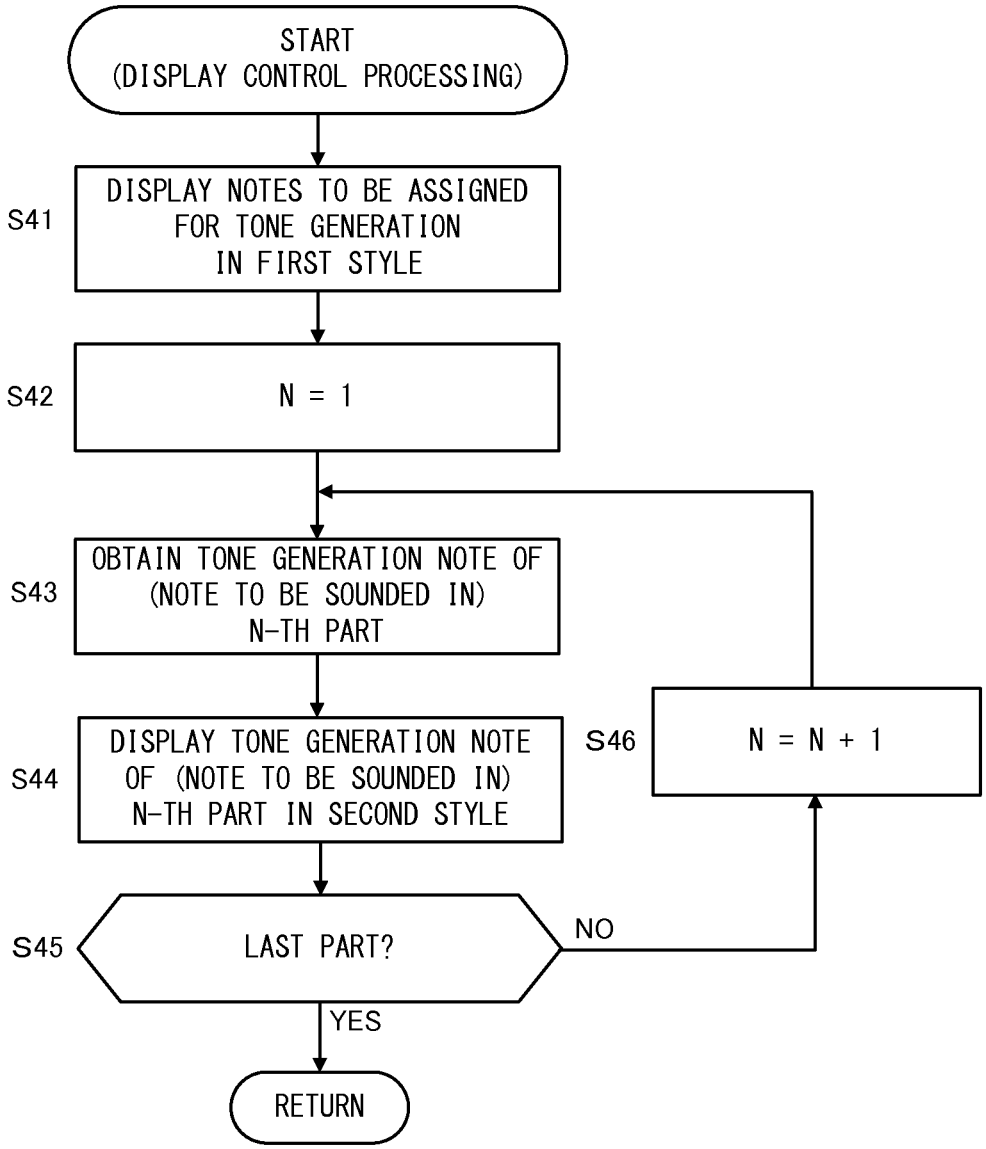

STORAGE MEDIUM, TONE GENERATION ASSIGNING APPARATUS AND TONE GENERATION ASSIGNING METHOD

TECHNICAL FIELD

The invention relates to a storage medium storing a program enabling, when performing tone generation, to assign a plurality of timbres to a plurality of notes and sound the notes in the assigned timbres, and also relates to a tone generation assigning apparatus and tone generation assigning method for performing control of such tone generation.

BACKGROUND ART

It has been conventionally performed to sound plural parts or timbres simultaneously when a user plays a keyboard in an electronic musical instrument. In particular, as a technique (hereinafter referred to as an "ensemble tone generating function") to distribute notes having plural different tone pitches, which are inputted by simultaneous depressing of plural keys or the like, among plural parts or timbres to sound the notes in the plural parts, there is known an electronic musical instrument which assigns either plural parts or timbres to plural notes inputted by using a keyboard or the like to sound the notes in the respective parts or timbres. For example, in the electronic musical instrument of PTL1, in a unison-two mode, predetermined plural parts (four parts for example), which constitute a composition of musical instruments and to each of which plural different timbres are set, are assigned substantially evenly according to the tone pitch order to respective notes of keys being depressed, thereby allowing that even when the number of notes of keys being depressed changes, the total number of parts to be sounded does not change, and the respective parts are utilized evenly.

Further, in the electronic musical instrument of PTL2, there are provided plural assigners, which assign (correlate) notes of depressed keys to tone generation channels. Each assigner has settings of an assignment priority rule (for example, assignment method: higher-pitch-prior-to-lower-pitch, last-note-prior-to-first-note, lower-note-prior-to-higher-note), a number of notes to be sounded, and timbres (piano A, violin B, or the like). The electronic musical instrument uses plural assigners each of which has suitable settings (for example, an assignment priority rule to be applied, the maximum number of notes of depressed keys able to sound, and timbres to be used in the tone (sound) generation) to enable functions such as dual, split, and so on.

However, in the electronic musical instruments, such as ones disclosed in PTL1 or PTL2, executing an ensemble tone generating function which sounds plural parts or timbres distributed into different keys, in order to obtain an effect of ensemble performance which is done as if respective performers corresponding to the respective parts or timbres play a musical tone independently, musical performance with the number of key depressions (for example, four tones) to a degree equivalent to the number of parts to achieve effective ensemble performance is demanded, which results in quite high difficulty.

On the other hand, there has been also known a technology related to an automatic accompaniment function to which an accompaniment is added automatically to musical performance by a user. For example, in an electronic musical instrument of PTL3, when the automatic accompaniment is on, based on a key depression operation to a key area assigned for automatic accompaniment by a key split point during the automatic accompaniment, a chord is detected and the automatic accompaniment is controlled.

CITATION LIST

Patent Literature

{PTL1} JP 2010-79179 A
{PTL2} JP 2565069 B2
{PTL3} JP 2002-341871 A

SUMMARY OF INVENTION

Technical Problem

However, when it is attempted to combine the automatic accompaniment function as described in PTL3 with the above-described ensemble tone generating function to utilize them, it is necessary, while performing a chord specifying operation for automatic accompaniment by one hand, to simultaneously perform depression operations to plural keys by only the other hand. Thus, it is difficult to obtain effective ensemble performance tones.

In view of such situations, it is an object of this invention to enable assignment of a plurality of parts to a plurality of notes according to easy performance operation, thereby generating sound like ensemble performance.

Solution to Problem

To attain the above object, a storage medium of the invention is a non-transitory machine-readable storage medium containing program instructions executable by a computer and enabling the computer to perform a method including: specifying a note to be sounded according to an operation by a user; generating one or more notes additionally and automatically; and assigning plural parts to the note specified in the specifying and the one or more notes generated in the generating, according to pitches of the specified note and the generated notes, each of the plural parts being associated with a predetermined timbre.

In the above storage medium, it is conceivable that the method further includes obtaining code information, and the one or more notes generated in the generating are determined based on the obtained code information.

Further, it is also conceivable that the obtaining determines a chord based on the note specified according to the operation by the user to obtain the chord information indicative of the determined chord.

It is also conceivable that the method further includes displaying the generated one or more notes in a predetermined style.

It is also conceivable that, in the assigning, the plural parts are respectively assigned to at least one note selected from among the specified note and the generated one or more notes according to tone pitch order or a note-on timing order thereof.

It is also conceivable that the method includes selecting, in each part, at least one note from among the specified note and the generated one or more notes according a note selecting rule corresponding to the part, and wherein a predetermined timbre is assigned to the selected note in each part by assigning the plural parts to the specified note and the generated notes.

It is also conceivable that the method includes selecting, in each part, at least one note from among the specified note and the generated one or more notes according to a number and a tone pitch order thereof, and wherein a predetermined timbre is assigned to the selected note in each part by assigning the plural parts to the specified note and the generated notes.

The invention can be realized or embodied also as device, method, system, computer program, or other arbitrary manner other than the above described storage mediums.

Advantageous Effects of Invention

The above configuration enables assignment of a plurality of parts to a plurality of notes by easy performance operation, thereby generating sound like ensemble performance.

BRIEF DESCRIPTION OF DRAWINGS

FIG. 1 is a hardware configuration block diagram of an electronic musical instrument according to an embodiment of the invention.

FIG. 2 is a block diagram illustrating an overview of a tone generation assigning function according to an embodiment of the invention.

FIG. 3 illustrates a screen display example when a harmony function is off according to an embodiment of the invention.

FIG. 4 illustrates a screen display example when a harmony function is on according to an embodiment of the invention.

FIG. 5A illustrates a screen display example according to another embodiment of the invention.

FIG. 5B illustrates a screen display example according to still another embodiment of the invention.

FIG. 5C illustrates a screen display example according to still another embodiment of the invention.

FIG. 6A illustrates an example of assignment types according to an embodiment of the invention.

FIG. 6B illustrates another example of the assignment types.

FIG. 6C illustrates still another example of the assignment types.

FIG. 7 is a flowchart illustrating an overall operation of the tone generation assignment display processing according to an embodiment of the invention.

FIG. 8 is a flowchart illustrating a process for determining a note to be assigned for tone generation according to an embodiment of this invention.

FIG. 9 is a flowchart illustrating a tone generation assignment processing according to an embodiment of the invention.

FIG. 10 is a flowchart illustrating a display control processing according to an embodiment of the invention.

DESCRIPTION OF EMBODIMENTS

Overview of Embodiment

According to a tone generation assigning system embodying the invention, in a tone generation assigning apparatus (EM) having an ensemble tone generating function which assigns plural parts (TC1 to TCn) to plural notes (Nki+Na), respectively, so as to sound the notes in predetermined timbres, when a note (Nki) to be sounded is specified (S24=YES), one or more notes (Na: Na1, Na2, . . . ) are automatically generated (AN: S25) with respect to the specified note, and parts (TC1 to TCn) to sound notes in predetermined timbres are assigned respectively to the specified note (Nki) and generated one or more notes (Na: Na1, Na2, . . . ) [AC: AS1 to ASn; S26 and S3 (FIG. 8)].

Specifically, the invention is configured so that when a performance note (Nki) is specified by a performance operation of a user, additional notes (Na: Na1, Na2, . . . ) are automatically generated with respect to the specified performance note, the additional notes (Na: Na1, Na2, . . . ) are added to the performance sound (Nki), and plural parts are distributed to plural sounds constituted of "performance note+additional notes" to sound the sounds in different timbres.

According to the invention, the tone generation assignment processing by the ensemble tone generating function is thus performed on not only the performance note based on a user operation but also the additional notes automatically generated in response to the performance note, and therefore, through a simple performance operation with a small number of key depressions, for example, even when only a single note is played, plural parts (timbres) can be assigned to plural notes and the plural parts can be sounded such that the plural parts are distributed (dispersed) to plural tone pitches, thereby generating sounds (musical tones) like ensemble performance.

A tone generation assignment program according to the invention is configured so that chord information is obtained (AN; S23), and one or more notes (Na) to be generated are determined (S25) based on the obtained chord information.

Therefore, according to the invention, even when only a single note is played, additional notes are added automatically and effectively based on the obtained chord information, and plural sounds constituted of "a performance note+additional notes" can be sounded such that plural parts are distributed to the plural sounds (musical tones).

Moreover, the tone generation assignment program according to the invention is configured so that a chord is determined based on note information (Nkc) specified according to a user operation, and the determined chord is obtained as the chord information (S23).

Therefore, according to the invention, in response to a musical performance in a chord detection key area, a chord is added to a musical performance in a performance key area, and the added chord can be sounded in timbres of respective parts.

Further, the tone generation assignment program according to the invention is configured so that one or more notes (Na: Na1, Na2, . . . ) generated automatically with respect to the specified note are displayed in a predetermined style [9, 13; S4 (FIG. 9)].

Therefore, according to the invention, the additional notes generated automatically in response to the performance note can be visually recognized easily.

Moreover, the tone generation assignment program by a characteristic of the invention is configured so that, during a part assignment (S26, S3), parts (TC1 to TCn) to be sounded in a predetermined timbre are assigned (first and second assign types) to each of a predetermined number of notes selected based on a tone pitch order or a note-on timing order of each note from among the specified note (Nki) and the generated one or more notes (Na: Na1, Na2, . . . ).

Therefore, according to the invention, an ensemble performance which has no artificiality and gives no unpleasant feeling can be realized.

[Hardware Configuration of Tone Generation State Displaying Apparatus]

In a tone generation assigning system according to an embodiment of the invention, an electronic musical instrument is used as a tone generation assigning apparatus, and this electronic musical instrument also function as a tone generation status displaying apparatus. FIG. 1 is a hardware configuration block diagram of the tone generation assigning apparatus according to an embodiment of this invention. This tone generation assigning apparatus that is the electronic musical instrument EM has, as a hardware configuration, elements such as a central processing unit (CPU) 1, a random access memory (RAM) 2, a read only memory (ROM) 3, a storage device 4, a detection circuit 5, a display circuit 6, a tone generator circuit 7, a communication interface (communication I/F) 8, and so on, and these elements 1 to 8 are connected one another via a bus 9.

The CPU 1 as a processor controlling the entire electronic musical instrument EM constitutes a data processor together with a RAM 2 and a ROM 3, and executes various processing including a tone generation assignment display processing according to various control programs including a tone generation assignment display processing program by utilizing clocks by a timer 10. The RAM 2 is used for temporarily storing or retaining various data needed for these processings, and the ROM 3 stores predetermined control programs and control data.

The storage device 4 includes a storage medium such as an HD (hard disk) and a flash memory and a drive device thereof, and is able to store control programs and various data in an arbitrary storage medium. The storage medium may be included in this device or may be removable like external various storage media (memory card, USB memory, CD-R, and the like). Further, in the storage device 4, various application programs and various data can be stored in advance.

The detection circuit 5 constitutes a performance controller together with performance controls 11 such as a keyboard, detects a performance operation of the performance controls 11, and introduces performance control information corresponding to the detected operation into the data processor (1 to 3). The data processor generates performance information based on this performance control information and transmits the generated performance information to the tone generator circuit 7. During the tone generation assignment display processing, the performance controls (hereinafter described as a keyboard) 11 functions as a tone generation instruction acceptor, the detection circuit 5 functions as a key depression state detector, and the data processor (1 to 3) functions as an additional sound generator (AN) and an assignment controller (AC). The detection circuit 5 also constitutes an input controller together with setting controls 12 such as switches, detects an operation to the setting controls 12, and introduces various information corresponding to the detected operation into the data processor (1 to 3).

The display circuit 6 constitutes a display unit together with the display 13 such as an LCD, controls displayed contents of the display 13 according to instructions from the CPU 1, and performs display assistance with respect to various user operations. For example, when the tone generation assignment display processing is performed, a tone generation state display screen, which displays on a keyboard image or the like a state that plural notes based on key depressions are sounded while distributing the notes among the plural parts, is displayed on the display 13. Further, by instructing a button displayed on the display 13 with a setting control (cursor switches) 12, the button can be used as a control. Note that the function of the setting controls 12 and the display 13 can be integrated using a touch panel. In this case, the display button can be used as a control which can be operated by touching.

The tone generator circuit 7 functions as a tone generator (sound source), includes a tone generator unit and a DSP (digital signal processor). The tone generator circuit 7 generates audio signals representing musical tone waveforms of various musical instrument timbres according to actual performance information based on performance control information from the performance controller (11, 5), automatic performance information stored in the storage device 4, automatic performance information received via the communication I/F 8 from an external automatic performance information source, or performance information generated by an additional sound generating function provided in this electronic musical instrument EM, in the tone generator unit. The tone generator circuit 7 can further add predetermined effects to the generated audio signals and perform mixing (DSP) to the generated audio signals, and output the resultant signals. A digital-analog conversion circuit (DAC) 14 functions as a musical tone output unit (SD) together with a sound system 15 having an amplifier, a speaker, or the like, converts a digital audio signal generated in the tone generator circuit 7 into an analog audio signal and outputs it to the sound system 15, thereby generating a musical tone based on the analog audio signal.

The communication I/F 8 includes a musical I/F such as MIDI, a general-purpose near distance wired I/F such as a USB and an IEEE1394, a general-purpose network I/F such as Ethernet (trademark), a general-purpose near distance wireless I/F such as a wireless LAN or Bluetooth (trademark) LAN, and the like and is used for communicating with an external apparatus via a communication network.

[Overview of Tone Generation Assigning Function]

This electronic musical instrument executes the tone generation assignment display processing according to the tone generation assignment display processing program, and functions as a tone generation assigning apparatus or a tone generation state displaying apparatus. FIG. 2 is a functional block diagram for describing an overview of the tone generation assigning function according to an embodiment of the invention. This electronic musical instrument EM functions as a tone generation assigning apparatus by the tone generation assignment display processing, and as illustrated in the diagram, executes the tone generation assigning function indicated by functional blocks of a tone generation instruction acceptor 111, a key depression state detector 105, an additional sound generator AN, an assignment controller AC, a musical tone generator 107, and a musical tone output unit SD.

The tone generation instruction acceptor 111 corresponds to the function of the performance controls 11 (FIG. 1), and for example, accepts a tone generation instruction by a user operation on performance controls of keyboard type. Specifically, when one or more notes are arbitrarily specified by a performance operation of the user, an instruction to generate a musical tone at this note is accepted by the tone generation instruction acceptor 111. For example, when any key on the keyboard is depressed, a note signal corresponding to the depressed key is supplied to the key depression state detector 105.

The key depression state detector 105 corresponds to the function of the detection circuit 5 (FIG. 1), and generates pitch information (note number) and key-on information (note-on event) of the depressed key based on the note signal supplied from the tone generation instruction acceptor 111, outputs key depression note information Nki+Nkc; Nk including the pitch information and the key-on information to the additional sound generator AN or the assignment controller AC, thereby notifying that (pitch of) the note corresponding to the key depression is specified. The key depression state detector 105 serves as a specifier. Note that when a key which has been depressed is released, information including pitch information (note number) and key-off information (note-off event) of this key is outputted in response to a note signal corresponding to the key release, thereby notifying that the note which has been specified corresponding to this key has disappeared.

Here, when a "harmony function" (which will be described later) is set to off (when virtual two changeover switches illustrated are on a harmony function off (Bhf) side as depicted by solid lines), key depression note information Nk: Nk1, Nk2, . . . (symbol "Nk" representatively denotes note information generated based on a key depressed manually) based on the key depression in the entire key range of the keyboard 11 is outputted as information of notes to be assigned for tone generation to the assignment controller AC. On the other hand, when the harmony function is set to on (when the virtual changeover switches illustrated are on a harmony function on (Bhn) side as depicted by dashed lines), key depression note information Nki of a performance key area based on a key depression in the performance key area (Ki) of the keyboard 11 and key depression note information Nkc (Nkc1, Nkc2, . . . ) of a chord key area based on a key depression in the chord key area (Kc) are outputted to the additional sound generator AN for generating an additional sound (additional musical tones).

The additional sound generator AN corresponds to the additional sound generating function of the data processor (FIG. 1: 1 to 3) including the CPU 1, operates when the harmony function is set to on, and automatically generates plural pieces of additional note information Na: Na1, Na2, . . . (symbol "Na" representatively denotes note information generated additionally and automatically) indicating predetermined notes based on the key depression note information Nki and Nkc inputted from the key depression state detector 105. Specifically, while the harmony function is on, when the key depression note information Nki of the performance key area based on the key depression in the performance key area (Ki) and the key depression note information Nkc of the chord key area based on the key depression in the chord key area (Kc) are inputted from the key depression state detector 105, the additional sound generator AN determines a chord based on the note (note number) of the key depression note information Nkc of the chord key area, automatically generates plural pieces of additional note information Na1, Na2, . . . having notes of pitches which harmonize the pitch of the note of the key depression note information Nki of the performance key area according to the determined chord, and outputs the key depression note information Nki of the performance key area and the plural pieces of additional note information Na1, Na2, . . . to the assignment controller AC as the information of notes to be assigned for tone generation.

The assignment controller AC corresponds to an assignment control function of the data processor (FIGS. 1: 1 to 3) including the CPU 1, includes plural assigners AS: AS1, AS2, . . . , ASi, . . . , ASn (symbol "AS" representatively denotes an assigner). The assignment controller AC accepts or obtains inputs of the "key depression note information Nk: Nk1, Nk2, . . . " or the "key depression note information Nki of the performance key area+additional note information Na: Na1, Na2, . . . " which are provided as information of notes to be assigned for tone generation from the key depression state detector 5 or the additional sound generator AN. Further, the assignment controller AC assigns a timbre for each assigner AS with respect to such key depression note information Nk or Nki+Na and outputs, as tone generation notes, sounding note information Nt: Nt1, Nt2, . . . , Nti, . . . , Ntn (symbol "Nt" representatively denotes sounding note information or a tone generation note), to which the respective timbres are assigned, to tone generation processing sequences TC: TC1, TC2, . . . , TCi, . . . , TCn corresponding to the assigner AS.

Describing more specifically, a timbre can be arbitrarily set to each assigner AS, and it is possible to set to each assigner AS "assignment criteria" according to a predetermined note determining rule ("assignment type"). The assignment criteria determines which note information among the note information Nk or Nki+Na to be assigned for tone generation should be sounded in the timbre set to the corresponding assigner AS (in other words, which note should be assigned to the timbre corresponding to the assigner AS) or the like based on the tone pitch of the note (note number) in each note information to be assigned for tone generation and the note-on timing order thereof. Therefore, when the note information Nk or Nki+Na to be assigned for tone generation are inputted to the assignment controller AC, each assigner AS determines which note information among the note information Nk or Nki+Na to be assigned for tone generation should be sounded in the timbre set to the assigner AS based on the respective settings thereof, and thereby a certain note among the notes to be assigned for tone generation is assigned to the timbre part set to the assigner AS. Then, the note information determined to be sounded by each assigner AS is supplied as the sounding note information Nt to the musical tone generator 107.

The musical tone generator 107 corresponds to the function of the tone generator circuit 7 (FIG. 1) and includes plural tone generation processing sequences TC1 to TCn, and the musical tone output unit SD corresponds to the functions of the DAC 14 and the sound system 15. Specifically, in the musical tone generating unit 7, the sounding note information Nt determined in each assigner AS in the assignment controller AC is supplied to the tone generation processing sequence TC corresponding to the assigner AS, each tone generation processing sequence TC generates an audio signal in the assigned timbre based on each piece of the sounding note information Nt, and the generated audio signal is sounded via the speaker of the musical tone output unit SD. Note that the tone generation sequence corresponding to the assigner AS is referred to as a "part". Further, each tone generation processing sequence TC is constituted of one or more tone generation channels to which the same timbre is set, and each assigner AS is configured to instruct the corresponding tone generation processing sequence TC to generate, in the timbre set to the assigner AS, sound of one or plural notes of sounding note information Nt which are determined to be sounded. Thus, the number of tone generation processing sequences TC does not necessarily match the number of assigners AS. However, in the illustrated example, for simplicity of description, the assigner AS, the part, and the tone generation processing sequence TC corresponds one by one and are of the same number "n".

As described above, this electronic musical instrument EM functions as the tone generation assigning apparatus, and while the harmony function is off, the key depression note information Nk are inputted as a note to be assigned for tone generation from the key depression state detector 5 to the assignment controller AC, and the assignment controller AC assigns a note complying with the assignment criteria of each assigner AS among the inputted key depression note information Nk to the part associated with the timbre set to the assigner AS to allow the note to sound in the timbre. On the other hand, while the harmony function is on, the additional sound generator AN determines a chord based on notes of the key depression note information Nkc of the chord key area (Kc), plural additional notes Na: Na1, Na2, . . . having pitches which harmonize the pitch of the note of the key depression note information Nki of the performance key area (Ki) are generated automatically according to the determined chord, "key depression note information Nki of the performance key area+additional note information Na" are inputted as notes to be assigned for tone generation to the assignment controller AC, and the assignment controller AC assigns plural parts (timbres) to the inputted "key depression note information Nki of the performance key area+additional note information Na" similarly to that while the harmony function is off, to thereby sound plural notes distributed among the timbres of the plural parts. That is, while the harmony function is on, tone generation assignment processing by the ensemble tone generating function is implemented on not only the key depression note information Nki based on the user's musical performance but also the additional note information Na generated automatically corresponding to the key depression note information Nki, and thus an effect as if an ensemble performance is performed can be obtained by a simple performance operation with a small number of key depressions.

[Display Example]

This electronic musical instrument EM functions as a tone generation state displaying apparatus by a tone generation assignment display processing, displays tone generation state of each part on a screen corresponding to execution of the ensemble tone generating function which assigns plural parts to plural notes and generates sound of the notes, and, at this time, displays in different display styles a "note not to be sounded" and a "note to be sounded" (Nt) in each part with respect to notes for the assignment inputted for assignment control. FIG. 3 and FIG. 4 illustrate a display example for describing a tone generation state display function according to an embodiment of the invention. Note that in the following description, it is assumed that assigners AS, parts, and tone generation processing sequences TC correspond one to one and are of the same number (n=4), and for example, a musical instrument timbre: "trumpet" is set to a first assigner, a first part (PART 1), and a first sequence TC1; a musical instrument timbre: "trombone" to a second assigner, a second part (PART 2), and a second sequence TC2; a musical instrument timbre: "tenor sax" to a third assigner, a third part (PART 3), and a third sequence TC3; and a musical instrument timbre: "baritone sax" to a fourth assigner, a fourth part (PART 4), and a fourth sequence TC4.

In this electronic musical instrument EM, the tone generation state display screen as illustrated is displayed on the display 13 during the tone generation assignment display processing. On the tone generation state display screen, four keyboard images Kb1 to Kb4 (which are displayed only and cannot be operated) are displayed corresponding to four part name descriptions: "PART 1" to "PART 4", and a key assignment type setting area Sa and a harmony setting area Sh are provided on a left and right side below these keyboard images Kb1 to Kb4. In the key assignment type setting area Sa, three assignment type specifying buttons Ba1 to Ba3 are displayed operably, and in the harmony setting area Sh, a harmony function on button Bhn, a harmony function off button Bhf, and two harmony type specification buttons Bh1 and Bh2 are displayed operably. That is, the respective buttons Ba1 to Ba3, Bhn, Bhf, Bh1, and Bh2 are operable by operating the corresponding setting control (such as switch) 12 on the control panel, and when the setting control 12 and the display 13 are constituted of a touch panel, the respective buttons can be operated directly.

FIG. 3 illustrates the tone generation state display screen when the "harmony function" is set to off by operating the harmony function off button Bhf of the harmony setting area Sh [the button Bhf is displayed by highlighting (high-brightness display)] and the first assignment type "ASSIGNMENT TYPE 1" is specified by operating the first assignment type specifying button Ba1 of the key assignment type setting area Sa (button Ba1 is displayed by highlighting). Further, this tone generation state display screen depicts that keys: "C3, E3, G3 and C4" are currently depressed by the user as indicated by arrows right above display areas of the keyboard images Kb1 to Kb4. Specifically, the key depression note information Nk1 to Nk4: "C3, E3, G3 and C4" based on depressed keys in the entire key area of the keyboard (performance controls) 11 are all inputted as notes to be assigned for tone generation to the assignment controller AC.

In this case, according to the note determining rule defined by the first assignment type, among the notes of the key depression Nk1 to Nk4: "C3, E3, G3 and C4" inputted as notes to be assigned for tone generation, the note Nk4: "C4" is selected as a tone generation note Nt1 in the first part, the note Nk3: "G3" is selected as a tone generation note Nt2 in the second part, the note Nk2: "E3" is selected as a tone generation note Nt3 in the third part, the note Nk1: "C3" is selected as a tone generation note Nt4 in the fourth part. The selected tone generation notes Nt1 to Nt4 are sent to the tone generation processing sequences TC1 to TC4 of the musical tone generating unit 7 via the first to fourth assigners, and are sounded in the timbres (in this case, "trumpet", "trombone", "tenor sax" and "baritone sax") set to the respective assigners corresponding to each tone generation processing sequence.

According to this, the display unit (6, 13) emphatically displays, in the keyboard images Kb1 to Kb4, respective keys corresponding to the tone generation notes Nt1 to Nt4 in a predetermined display style (in orange for example) as indicated by a netted pattern. Further, the display unit (6, 13) emphatically displays, in the keyboard images Kb1 to Kb4, respective keys corresponding to notes of the key depression Nk which are not selected as the tone generation notes Nt in the respective first to fourth parts in a different display style (in gray for example) as illustrated by hatching.

As described above, when the "harmony function" is set to off, notes of the key depression Nk1 to Nk4 are all assumed as the notes to be assigned for tone generation, and in the respective first to fourth parts, the keys corresponding to the notes of the key depressions Nk1 to Nk4 are emphatically displayed (in a display style to be recognized as visually clearly different from other keys, for example, a color or pattern is added or brightness is changed). However, among these notes Nk1 to Nk4, the keys corresponding to notes not to be sounded in the respective first to fourth parts are displayed in a predetermined display style, namely, the first style (in grey for example), and the keys corresponding to the notes (Nt1 to Nt4) to be sounded in the respective first to fourth parts are displayed in another display style, namely, the second style (in orange for example).

FIG. 4 illustrates the tone generation state display screen in the case where the "harmony function" is set to on and the "first harmony type" is specified, by operating the harmony function on button Bhn and the first harmony type specifying button Bh1 of the harmony setting area Sh, and the first assignment type "ASSIGNMENT TYPE 1" is specified by operating the first assignment type specifying button Ba1 of the key assignment type setting area Sa [the buttons Bhn, Bh1 and Ba1 are displayed by highlighting (high-brightness display)]. Further, this tone generation state display screen represents that the keys: "G1, C2, E2 and C3" are currently depressed by the user as indicated by arrows. When the "harmony function" is set to on and the first harmony type is specified, a split function turns on and the key area is divided at a split point set in advance. In this screen, a split description: "SP", a reverse-triangle split mark, and a dashed line running below the split mark displays the split point, and the keys: "G1, C2 and E2" are on the left side of the split point, that is, in the chord key area Kc, and the key "C3" is on the right side of the split point, that is, in the performance key area Ki. Specifically, the note of the depressed key Nki: "C3" of the performance key area based on the depressed key in the performance key area Ki of the keyboard (performance controls) 11 and additional notes Na1 to Na3: "E2, G2 and E3" generated by the additional sound generator AN according to a chord determination based on the depressed key notes Nkc1 to Nkc3: "G1, C2 and E2" of the chord key area based on the depressed keys in the chord key area Kc are inputted as the notes to be assigned for tone generation to the assignment controller AC.

Here, the split function and the function of the additional sound generator AN while the harmony function is on will be described in more detail. When the split function is turned on, the key area of the keyboard 11 is divided into the performance key area Ki and the chord key area Kc at the split point set in advance. In the example of FIG. 4, the key area is divided left and right at the note: F#2 being the split point, where the note: F#2 and below is the chord key area Kc for chord key detection, and the note: G2 and above operates as the performance key area Ki for ensemble tone generation. Note that regarding turning on of the split key function, the split function may be turned on or off in conjunction with turning on or off of the harmony function, or the split function may be turning on or off by a user operation on a switch or the like (setting controls 12) on the control panel.

As indicated by arrows in the diagram, when the user depresses "G1, C2, E2 and C3" on the keyboard 11, the additional sound generator AN operates as follows:

(1) Among the notes of the depressed keys, the additional sound generator AN assumes the "C3" in the performance key area Ki for ensemble tone generation as a note to be assigned for tone generation.

(2) Among the notes of the depressed keys, the additional sound generator AN makes a chord determination based on "G1, C2 and E2" present in the chord key area Kc. The chord determination is performed using an existing technique (for example, ones described in JP S56(1981)-109398 A and U.S. Pat. No. 4,353,278), and in this case, for example, "C major" is determined as a chord.

(3) The additional sound generator AN additionally generates additional sound based on the chord determined in (2) according to predetermined rules, to the "C3" assumed as the note to be assigned for tone generation in (1).

An existing technique (for example, one described in JP H08(1996)-179771 A) is used for the rules for adding the additional sound. In the example of FIG. 4, the first harmony type of "HARMONY TYPE 1" and the second harmony type of "HARMONY TYPE 2" can be selected, and adding rules are different depending on the type. For example, for the currently selected first harmony type, three to five sounds (which differ depending on the chord) within one octave above and below the key depressed by the user are added.

By such note adding function, "E2, G2 and E3" are determined as the notes to be added, and "E2, G2, C3 and E3" combining these additional notes "E2, G2, E3" with "C3" assumed as the note to be assigned for tone generation in (1) are inputted to the assignment controller AC.

Note that in the first harmony type, harmony sound is added as described above based on the chord, but the second harmony type is a type which generates harmony sound not based on the chord, and for example, a note higher (or lower) by one octave or a note higher by five degrees is added to the input sound.

In the assignment controller AC, the note of the depressed key Nki: "C3" of the performance key area Ki inputted from the additional sound generator AN and the additional notes Na1 to Na3: "E2, G2, E3" are accepted and assumed as notes to be assigned for tone generation, and the notes Nt1 to Nt4 to be sounded in the respective first to fourth parts are determined according to the currently selected first assignment type. Then, the notes Nt1 to Nt4 to be sounded are displayed in orange for example, and the notes not to be sounded are displayed in gray for example, among the notes to be assigned for tone generation.

Specifically, according to the note determining rule defined by the first assignment type, among the note of the depressed key Nki: "C3" of the performance key area Ki and the additional notes Na1 to Na3: "E2, G2 and E3" which are inputted as the notes to be assigned for tone generation, the additional note Na3: "E3" is selected as the tone generation note Nt1 in the first part, the note of the depressed key Nki: "C3" of the performance key area Ki is selected as the tone generation note Nt2 in the second part, the additional note Na2: "G2" is selected as the tone generation note Nt3 in the third part, the additional note Na1: "E2" is selected as the tone generation note Nt4 in the fourth part. The selected tone generation notes Nt1 to Nt4 are sent to the tone generation processing sequences TC1 to TC4 of the musical tone generating unit 7 via the first to fourth assigners, and sounded in the timbres (in this case, "trumpet", "trombone", "tenor sax" and "baritone sax") set to the respective assigner corresponding to each tone generation processing sequences.

According to this, the display unit (6, 13) emphatically displays, in the keyboard images Kb1 to Kb4, respective keys corresponding to the tone generation notes Nt1 to Nt4 in a predetermined display style (in orange for example) as indicated by a netted pattern. Further, respective keys in the keyboard images Kb1 to Kb4 corresponding to the notes of the depressed key Nki in the performance key area Ki or the additional notes Na1 to Na3 not selected as the tone generation notes Nt in the respective first to fourth parts are emphatically displayed in a different display style (in gray for example) as illustrated by hatching.

As described above, when the "harmony function" is set to on, the note of the depressed key Nki of the performance key area Ki and the additional notes Na1 to Na3 are all assumed as the notes to be assigned for tone generation, and the keys corresponding to the notes Nki, Na1 to Na3 to be assigned for tone generation are emphatically displayed in the respective first to fourth parts. However, among these notes, the keys corresponding to the notes not to be sounded in the respective first to fourth parts are displayed in a predetermined display style, namely, the first style (in gray for example), and the keys corresponding to the notes (Nt1 to Nt4) to be sounded in the respective first to fourth parts are displayed in a different display style, namely, the second style (in orange for example).

Note that for convenience, "PART 1", "PART 2", . . . are used to describe part names in FIG. 3 and FIG. 4, but in practice, names of musical instrument timbres set to the part, such as "trumpet", "trombone", "tenor sax", "baritone sax", . . . and the like, predetermined musical instrument timbre symbols or the like may be used. Further, the symbols for describing notes in the figures: Nk1, Nk2, . . . ; Nkc1, Nkc2, . . . ; Nki; G1, C2, E2, G2, C3, E3, G3, C4; (NW, (Nt2), . . . ; (Na1), (Na2), . . . are not displayed on the screen.

The arrows indicating depressed keys may be omitted or displayed by an arrow image or the like. Moreover, regarding the split point (position of note where the key area is divided) set when the split function is on, although the split point is displayed with the split description: "SP", the reverse-triangular split mark, and the dashed line vertically passing through the position above the keyboard images Kb1 to Kb4 corresponding to the split point in FIG. 3 and FIG. 4, the note at the split point may be displayed at a position set arbitrarily by a letter description, or one or more of these split point display methods may be employed. In some cases, the split position on this screen may be omitted, and the note of the split point may be displayed on a different text display device on the display panel.

[Other Display Styles]

In FIG. 3 and FIG. 4, those displaying the keyboard image on the tone generation state display screen and controlling the display styles of key images corresponding to the notes to be assigned for tone generation and the tone generation notes have been described, but the display of the keyboard images respectively corresponding to the parts on the tone generation state display screen is not essential. Any style can be employed as long as it can display note information, and for example, a staff notation, a note name description, or the like can be employed. FIG. 5A to FIG. 5C illustrate screen display examples according to other embodiments of the invention.

(1) Staff Notation Display

On the tone generation state display screen, musical notes representing the notes to be assigned for tone generation and the tone generation notes Nt may be displayed in a staff notation, and the display styles of the musical notes may be controlled. For example, as illustrated in FIG. 5A, a staff notation are displayed regarding each of the first to fourth parts, and the notes to be assigned for tone generation are displayed on each staff notation by a white musical note image Wh [inside the musical note is unpatterned (blank) for example] as a first style. However, the tone generation notes Nt1 to Nt4 of the respective first to fourth parts are displayed in the staff notation by a colored musical note image Co (netted pattern in the musical note representing an orange color for example) as a second style.

(2) Note Name Text Display

On the tone generation state display screen, texts describing the note names of the notes to be assigned for tone generation and the tone generation note Nt may be displayed, and a display style of these texts may be controlled. For example, as illustrated in FIG. 5B, regarding each of the first to fourth parts, text images describing note names of the notes to be assigned for tone generation are displayed by a normal font as a first style, but text images describing note names of the tone generation notes Nt1 to Nt4 are displayed with an underline Un as a second style. This embodiment is applicable also to the case where a display having a low display performance is used as the display 13.

(3) Common Keyboard Display

On the tone generation state display screen, a common keyboard may be displayed for the respective parts instead of displaying a keyboard in every part, and simplified display of the notes to be assigned for tone generation and tone generation notes Nt may be performed for each part. For example, as illustrated in FIG. 5C, displayed are a keyboard image Kbc common to the respective first to fourth parts and part lines L1 to L4 extending in an arrangement direction of the keyboard image Kbc (lateral direction of the screen) corresponding to the respective part name descriptions ("PART 1" to "PART 4") arranged in a vertical direction of the screen. Then, on the common keyboard image Kbc, the key images corresponding to the notes Nt1 to Nt4 to be assigned for tone generation are emphatically displayed [netted patterns of the key images representing an orange color for example]. On the respective part lines L1 to L4, circle marks (○ symbols) Mkb are displayed at positions corresponding to the notes to be assigned for tone generation, whereas star marks (★ marks) Mka of larger size are displayed at positions corresponding to the tone generation notes Nt1 to Nt4 of the corresponding first to fourth parts. That is, the notes to be assigned for tone generation for the respective first to fourth parts are displayed in a first style by the "circle marks (○ symbol) Mkb+emphatic display of key images", and the tone generation notes Nt1 to Nt4 of the respective first to fourth parts are displayed in a second style by the "star marks (★ symbol) Mka+emphatic display of key images".

Here, the display of the circle marks (○ symbols) Mkb may be omitted. In this case, the inputted notes to be assigned for tone generation are displayed in a first style by emphatic display (in orange for example) of the keyboard image Kbc (keys corresponding to Nt1 to Nt4), and the tone generation notes Nt1 to Nt4 of the respective first to fourth parts are displayed in a second style by the star marks (★ symbols) placed at the positions corresponding to the emphatic-displayed key images. Specifically, pitches of the accepted plural input notes to be assigned for tone generation are displayed in the first style (key image in orange for example), and pitches of the notes Nt selected to be sounded in each of the plural parts are displayed in the second style (star marks of the respective parts at the positions corresponding to the orange key images for example) corresponding to the respective parts, thereby making it easier to recognize that which note among the inputted notes is selected to be sounded in each part.

As described above, this electronic musical instrument EM functions as a tone generation assignment displaying apparatus, and in the assignment controller AC, inputs of plural notes (Nk1 to Nk4 in FIG. 3, Nki and Na1 to Na3 in FIG. 4) to be assigned for tone generation are accepted, and notes Nt to be sounded in each of the first to fourth parts are selected from the the plural notes to be assigned for tone generation according to the predetermined note determining rule called "assignment type". On the other hand, the display unit (6, 13) displays the tone generation states in the first to fourth parts on the screen, in which the display styles regarding the respective first to fourth parts of the notes Nt selected to be sounded are differentiated from the display styles of any other notes of the accepted input notes or all the notes. Specifically, regarding the respective first to fourth parts, among the accepted plural input notes (Nk1 to Nk4 in FIG. 3, Nki and Na1 to Na3 in FIG. 4) to be assigned for tone generation, notes not to be sounded in the respective first to fourth parts are displayed in a predetermined display style [gray key image (hatching in FIG. 3 and FIG. 4) for example], and the notes Nt selected to be sounded in the respective first to fourth parts are displayed in a different display style [orange key images (netted pattern in FIG. 3 and FIG. 4) for example]. Or, the accepted plural input notes to be assigned for tone generation are displayed in a predetermined display style [for example, orange key images (netted patterns) in the case where a circle mark is not displayed in FIG. 5C], and the notes Nt selected to be sounded in each of the first to fourth parts are displayed in a different display style corresponding to the first to fourth parts [for example, star marks placed at positions corresponding to the orange key images (netted patterns) in the case where a circle mark is not displayed in FIG. 5C].

Thus, when plural input notes are distributed among plural parts to be sounded, through a configuration such that an input note (tone pitch) not to be sounded and an input note (tone pitch) Nt to be sounded are in different display modes in each part, or all the notes (tone pitches) inputted and an input note (tone pitch) Nt to be sounded in each part are in different display modes, tone generation states of the respective parts can be visually confirmed easily as to what notes are accepted as an assignment target and which one is sounded among the accepted notes.

[Various Assignment Types]

In this electronic musical instrument EM, the assignment rules called "assignment types" are stored in the storage device 4 in a table format, and when plural parts are assigned to plural input notes by the tone generation assigning function, an assignment type selected arbitrarily by the user operation can be applied. FIG. 6A to FIG. 6C illustrate examples of assignment types according to an embodiment of the invention. These examples are suitable for the case where a timbre is set to each of the first to fourth parts corresponding to respective assigners AS1 to AS4.

(1) First Assignment Type

On the table of the first assignment type, as illustrated in FIG. 6A, an assignment criteria is set to each of the first to fourth parts corresponding to respective first to fourth assigners AS1 to AS4, the assignment criteria being defined as "target note", "priority method", and "number to be sounded". The "target note" defines a pitch condition of a note to be allowed to assign to the assigner AS. According to the definition of the "target note", one or more notes to which a part corresponding to the assigner AS is potentially assignable are selected from among all the notes to be assigned for tone generation. The pitch condition defined by the "target note" is, for example, "to extract all the notes (from all the notes to be assigned for tone generation)", "to exclude a note having the highest pitch (from all the notes to be assigned for tone generation)", "to extract up to two notes from a lower pitch side [to extract a note having the first lowest pitch and, if any, a note having the second lowest pitch from all the notes to be assigned for tone generation]", or so on.

The "priority method" defines the order of priority for determining a note (tone pitch) Nt to be actually sounded from the one or more notes selected according to the "target notes" defining a pitch condition of a note which is allowable to assign in the part. The "number to be sounded" defines the number of notes which can be sounded simultaneously via the assigner AS. Therefore, in the respective first to fourth parts, a predetermined number of tone generation notes (tone pitches) Nt defined by the "number to be sounded" is selected according to the definition of the "priority order". For example, when the "priority method" is set to the "higher-pitch-prior-to-lower-pitch", notes of the "number to be sounded" are selected from the highest note side of the notes selected according to the "target notes". When it is set to the "lower-pitch-prior-to-higher-pitch", notes of the "number to be sounded" are selected from the lowest note side of the notes selected according to "target notes". Further, when it is set to "last-note-prior-to-first-note", notes of the "number to be sounded" are selected from notes whose note-on timings are later from among the notes selected according to the "target notes". When it is "first-note-prior-to-last-note", notes of the "number to be sounded" are selected from notes whose note-on timings are earlier from among the notes selected according to the "target notes".

(2) Second Assignment Type

On the table of the second assignment type, as illustrated in FIG. 6B, an assignment criteria is set to each of the first to fourth parts corresponding to respective assigners AS1 to AS4, the assignment criteria being defined as "first target note", "second target note", "priority method", and "number to be sounded". The first assignment type and the second assignment type only differ in that, for extracting the tone generation note Nt in each part meeting a pitch condition from the notes to be assigned for tone generation, the first assignment type applies a filter of one stage, that is, "target note", whereas the second assignment type applies a filter of two stages, that is, "first target note" and "second target note". For example, a pitch condition of the "first target note" is, for example, "to extract all the notes (from all the notes to be assigned for tone generation)", "to exclude a note having the highest pitch (from all the notes to be assigned for tone generation)", "to exclude a note having the lowest pitch (from all the notes to be assigned for tone generation)", or so on. Further, a pitch condition of the "second target note" is, for example, "to extract up to two notes from a higher pitch side (extract a note having the first highest pitch and, if any, a note having the second highest pitch from all the notes to be assigned for tone generation)", "to extract up to two notes from a lower pitch side (extract a note having the first lowest pitch and, if any, a note having the second lowest pitch from all the notes to be assigned for tone generation)", or so on and may also be the case of no setting ("-").

When the first to fourth parts are assigned by applying the first or second assignment types, a note to be sounded in the respective parts is determined by the following procedure:

(a) Extraction processing: by applying a filter with a tone pitch according to a pitch condition defined by the "target note" or the "first target note" and the "second target note" of the respective first to fourth parts, notes corresponding to a specific pitch order are extracted or deleted from the notes to be assigned for tone generation, with regard to each of the first to fourth parts.

(b) With respect to the group of notes extracted in (a), according to the definition of the "priority method", that is, either the "higher-pitch-prior-to-lower-pitch" or "lower-pitch-prior-to-higher-pitch" based on the pitch order, or the "last-note-prior-to-first-note" or "first-note-prior-to-last-note" based on the note-on timing order, notes of the number indicated by the "number to be sounded" are selected, thereby the tone generation notes Nt1 to Nt4 to be sounded in each part are determined.

In the first and second assignment types, when the "number to be sounded" is 1 as in FIG. 6 (1) and (2), all the first to fourth parts become "monophonic tone generation" to always generate only one or less sound, but there may be a part which performs "polyphonic tone generation" capable of generating two or more sounds, and a part to which the "number to be sounded" being two or more is set is a polyphonic tone generation part.

(3) Third Assignment Type

On the table of the third assignment type, as illustrated in FIG. 6C, an assignment criteria is set to each of the first to fourth parts corresponding to respective assigners AS1 to AS4, the assignment criteria being defined as notes to be selected with respect to the number of notes to be assigned for tone generation indicated by one to four of the "number of notes". When the third assignment type is applied to assign the first to fourth parts, note to be sounded in each part in determined in the following procedure:

(a) When the notes to be assigned for tone generation are determined, the number of the notes is confirmed, and the confirmed number is determined as the "number of notes".

(b) Which note in the respective first to fourth parts should be sounded are determined based on the assignment criteria, which is related to the pitch order in the respective first to fourth parts, corresponding to "number of notes" determined in (a) among the assignment criterion corresponding to one note to four notes in the table of FIG. 6C.

Note that although only the case of from one note to four notes is defined in the table of FIG. 6C, a definition may be given for the case where there are five or more notes to be assigned for tone generation. Alternatively, when the number of notes to be assigned for tone generation exceeds four, the table of FIG. 6C may be applied after selecting four notes based on a predetermined priority method (for example, last-note-prior-to-first-note).

[Operation Example of the Tone Generation Assignment Display Processing]

FIG. 7 to FIG. 10 are flowcharts illustrating an operation of the tone generation assignment display processing according to an embodiment of the invention. A flowchart of FIG. 7 illustrates an overall and basic operation of the tone generation assignment display processing, and flowcharts of FIG. 8 to FIG. 10 illustrate specific operations of a process for determining a note to be assigned for tone generation, a tone generation assignment processing, and a display control processing, respectively, in the tone generation assignment display processing of FIG. 7.

The tone generation assignment display processing of FIG. 7 starts when a key depression state on the keyboard 11 changes. When the tone generation assignment display processing starts, the CPU 1 of the electronic musical instrument EM firstly detects in step S1 a change in key depression state on the keyboard 11, and executes in subsequent step S2 the process for determining a note to be assigned for tone generation illustrated in FIG. 8 to determine notes to be assigned for tone generation. Next, the CPU 1 proceeds to step S3 to execute the tone generation assignment processing illustrated in FIG. 9, determines the tone generation note Nt to be sounded in the respective parts, further executes the display control processing illustrated in FIG. 10 in step S4 to display tone generation states of the respective parts on the display 13 according to a result of the tone generation assignment processing, and proceeds to step S5. In step S5, the CPU 1 instructs the musical tone generating unit 7 to generate an audio signal based on the tone generation notes Nt determined in the tone generation assignment processing, and perform tone generation through the musical tone output unit SD. Further, when a note off with respect to the note of the depressed key corresponding to the tone generation note Nt is detected in step S1, the CPU 1 starts release of tone generation of the note to end the tone generation. Then, when a processing regarding the start and the end of the tone generation of step S5 is finished, the CPU 1 ends the tone generation assignment display processing at this time and waits for a next change of the key depression state.

<Process for Determining Notes to be Assigned for Tone Generation>

Once the process for determining notes to be assigned for tone generation of FIG. 8 starts, the CPU 1 of the electronic musical instrument EM firstly judges in step S21 whether or not the change in the key depression state detected in step S1 indicates a key depression in the chord key area Kc. Here, when it is judged that there is no key depression in the chord key area Kc (that is, chord key division is not performed or a key depression is performed only in the performance key area Ki) (S21=NO), the CPU 1 proceeds to step S22, sets all the currently depressed notes Nk (for example, Nk1 to Nk4 on the uppermost part of FIG. 3) as the notes to be assigned for tone generation, ends the process for determining a note to be assigned for tone generation of this time, and returns to step S3 of the tone generation assignment display processing (FIG. 7) [=proceeds to step S31 of the tone generation assignment processing (FIG. 9)].

On the one hand, when it is judged in step S21 that there is a key depression in the chord key area Kc (and key area division is performed) (S21=YES), the CPU 1 proceeds to step S23 to determine a chord from the note of the depressed key Nkc of the chord key area Kc (for example, Nkc1 to Nkc3 of the uppermost part of FIG. 4) and proceeds to step S24. In step S24, the CPU 1 judges whether there is a key depression or not in the performance key area Ki in the key depression state detected in step S1, and when it is judged that there is no key depression in the performance key area Ki (S24=NO), the CPU 1 returns to step S3 of the tone generation assignment display processing (FIG. 7).

On the other hand, when it is judged in step S24 that there is a key depression in the performance key area Ki (S24=YES), the CPU 1 proceeds to step S25 to determine the additional note Na (for example, Na1 to Na3 of FIG. 4) indicative of the determined chord with respect to the note Nki of the depressed key note of the performance key area Ki and proceeds to step S26. In step S26, the CPU 1 sets the note Nki of the depressed key of the performance key area Ki and the additional note Na as the notes to be assigned for tone generation, and returns to step S3 of the tone generation assignment display processing (FIG. 7).

<Tone Generation Assignment Processing>

Once the tone generation assignment processing of FIG. 9 starts, the CPU 1 of the electronic musical instrument EM firstly obtains (accepts) in step S31 the notes to be assigned for tone generation set in steps S22 or S26, sets in step S32 "1" (N=1) to the assigner number N (N=1 to n in FIG. 2, and N=1 to 4 in FIG. 3 and so on. N is also a part number.), and proceeds to step S33.

In step S33, the CPU 1 selects the N-th assigner, and in step S34, the CPU 1 determines (selects) the tone generation note Nt to be sounded in the corresponding part N based on the setting of the N-th assigner, proceeds to step S35, and judges whether or not the current assigner number N indicates the last assigner or not. Here, when the current assigner number N has not reached the number of the last assigner ("n" in FIG. 2 or "4" in FIG. 3 and so on) (S35=NO), the CPU 1 increments in step S36 the currently set assigner number N by 1 (N=N+1) and returns to step S33.

Then, while the assigner number N has not reached the number of the last assigner (S35=NO), the processing of steps S33 to S36 is repeated, and when the assigner number N reach the number of the last assigner (S35=YES), the CPU 1 ends the tone generation assignment processing of this time, and returns to step S4 of the tone generation assignment display processing (FIG. 7) [=proceeds to step S41 of the display control processing (FIG. 10)]. That is, by the tone generation assignment processing of FIG. 9, the tone generation note Nt of each part is determined, and when the tone generation notes Nt of all the parts are determined, the CPU 1 proceeds to next processing.

<Display Control Processing>

Once the display control processing of FIG. 10 starts, the CPU 1 of the electronic musical instrument EM firstly controls the display unit (6, 13) in step S41 to display the notes to be assigned for tone generation in the first style on the tone generation state display screen displayed on the display 13. Next, in step S42, the CPU 1 sets "1" (N=1) to the part number N (N=1 to n in FIG. 2, and N=1 to 4 in FIG. 3 and so on. N is also an assigner number), and proceeds to step S43.

In step S43, the CPU 1 obtains the tone generation note Nt of the N-th part, and in step S44, the CPU 1 controls the display unit (6, 13) to display the tone generation note Nt in the second style on the tone generation state display screen displayed on the display 13. In this case, when the input note to be sounded (which is the tone generation note Nt) and the input notes not to be sounded are in different display styles in each part, the tone generation note Nt of the part N are changed from the first style to the second style among the notes to be assigned for tone generation and displayed in step S41 in the first style. For example, when the display styles of FIG. 3 and FIG. 4 are employed, in step S41, the key images corresponding to the notes to be assigned for tone generation are displayed in gray (first style), and in step S44, the displayed color of the key image corresponding to the tone generation note Nt is switched (overwritten) from gray to orange (second style).

Next, the CPU 1 judges whether the current part number N indicates the last part or not, and when it has not reached the number of the last part ("n" in FIG. 2, "4" in FIG. 3 and so on) (S45=NO), the CPU increments in step S46 the currently set part number N by 1 (N=N+1) and returns to step S43. Then, while the part number N has not reached the number of the last part (S45=NO), the processing of steps S43 to S46 is repeated, and when reaches the number of the last part (S45=YES), the CPU 1 ends the display control processing of this time and returns to step S5 of the tone generation assignment display processing (FIG. 7).

Note that in the example of the display control processing in FIG. 10, for example, when the input note to be sounded and the input notes not to be sounded are in different display styles in each part as illustrated in FIG. 3 and FIG. 4, the processing to overwrite the first style of the tone generation notes Nt in each part to the second style is performed (S44) after the processing to display the notes to be assigned for tone generation in the first style is performed (S41). However, the order of processings is not limited to this. It may be configured so that after the processing to distinguish the notes to be assigned for tone generation as "notes not to be sounded" and "notes to be sounded" in each part is performed, the notes not to be sounded are displayed in the first style and the notes (Nt) to be sounded is displayed in the second style.

Various Embodiments

In the foregoing, embodiments of the tone generation state display system related to the invention have been described with reference to the drawings, but this invention is not limited to the structures or configuration of these embodiments, and various changes can be made. For example, for acceptance of note-on by performance operation by the user, any form of performance control, such as a stringed instrument, a pad, or a flat control, may be used instead of the keyboard. Further, the tone generation instruction may be accepted via the communication I/F (8) from an external device.

The automatically generated plural notes are not limited to the harmony sounds to be added. For example, it can be adapted to the case where plural appropriate notes played on the keyboard are converted into appropriate notes according to the chord, or the case where a chord phrase is generated automatically when one note is played.

The chord detection is not limited to a performance of a chord in a chord key area, and it may be a method to estimate a chord from a key depression of only one or two notes. Alternately, chord information in song data may be utilized, or a method directly specifying a chord name, or the like may be employed.

REFERENCE SIGNS LIST

EM electronic musical instrument (tone generation assigning apparatus, tone generation state displaying apparatus), 13 display or its screen,
AN additional sound generator
AC assignment controller
AS: AS1, AS2, . . . , ASi, . . . , ASn assigner
SD musical tone output unit (DAC and sound system)
TC1 to TCn tone generation processing sequences (tone generation sequence) corresponding to first to n-th parts
Nk: Nk1, Nk2, . . . note of depressed key or key depression note information
Nki note of depressed key of performance key area or key depression note information of performance key area
Nkc note of depressed key of chord key area or key depression note information of chord key area
Na: Na1, Na2, . . . additional note or additional note information
Nt: Nt1, Nt2, . . . tone generation note or sounding note information
Kb1 to Kb4, Kbc part keyboard image and common keyboard image
Sa assignment type setting area
Ba1 to Ba3 assignment type specifying button
Sh harmony setting area
Bhn, Bhf harmony function on button and harmony function off button
Bh1, Bh2 harmony type specification button
SP, Ki, Kc split description, performance key area, and chord key area,
Un underline
L1 to L4 part line
Mka, Mkb star mark (★ symbol) and circle mark (○ symbol).

The invention claimed is:

1. A non-transitory machine-readable storage medium containing program instructions executable by a computer and enabling the computer to perform a method comprising:

detecting, by detection circuitry, an operation by a user on a single user-operable performance control to specify a performance note to be sounded according to the operation by the user;

generating, by a processor, one or more additional notes automatically; and assigning, by the processor, predetermined plural timbres to the specified performance note and the generated one or more additional notes, according to pitches of the specified performance note and the generated one or more additional notes, wherein each of the assigned plural timbres is respectively assigned to at least one note from among the specified performance note and the generated one or more additional notes according to tone pitch order or a note-on timing order thereof; and generating, by tone generator circuitry, audio signals representing musical tone waveforms of the specified performance note and the generated one or more additional notes in their assigned timbres, the generated audio signals to be sounded from a speaker.

2. The storage medium according to claim 1, wherein the method further comprises:

obtaining code information and determining the one or more additional notes to be generated based on the obtained code information.

3. The storage medium according to claim 2, wherein obtaining the code information includes determining a chord based on one or more notes specified according to an operation by a user to obtain chord information indicative of the determined chord.

4. The storage medium according to claim 1, wherein the method further comprises displaying the generated one or more additional notes in a predetermined style.

5. The storage medium according to claim 1, wherein the method comprises selecting, for each of the predetermined timbres, at least one note from among the specified performance note and the generated one or more additional notes according to a note selecting rule corresponding to the timbre, and wherein each predetermined timbre is assigned to the note selected for the timbre.

6. The storage medium according to claim 1, wherein the method comprises selecting, for each of the predetermined timbres, at least one note from among the specified performance note and the generated one or more additional notes according to a number and a tone pitch order thereof, and wherein each predetermined timbre is assigned to the selected note selected for the timbre.

7. A tone generation assigning apparatus comprising:

detection circuitry configured to detect an operation by a user on a single user-operable performance control to specify a performance note to be sounded according to the operation by the user;

a processor configured to:

generate one or more additional notes automatically; and assign predetermined plural timbres to the specified performance note and the generated one or more additional notes, according to pitches of the specified performance note and the generated one or more additional notes, wherein each of the assigned plural timbres is respectively assigned to at least one note from among the specified performance note and the generated one or more additional notes according to tone pitch order or a note-on timing order thereof; and tone generator circuitry configured to generate audio signals representing musical tone waveforms of the specified performance note and the generated one or more additional notes in their assigned timbres, the generated audio signals to be sounded from a speaker.

8. The tone generation assigning apparatus according to claim 7, wherein the processor is configured to:

obtain code information and determine the one or more additional notes to be generated based on the obtained code information.

9. The tone generation assigning apparatus according to claim 8, wherein the processor is configured to determine a chord based on one or more notes specified according to an operation by a user to obtain chord information indicative of the determined chord.

10. The tone generation assigning apparatus according to claim 7, wherein the processor is configured to control a display unit to display the generated one or more additional notes in a predetermined style.

11. The tone generation assigning apparatus according to claim 7, wherein the processor is configured to select, for each of the predetermined timbres, at least one note from among the specified performance note and the generated one or more additional notes according to a note selecting rule corresponding to the timbre, and wherein each predetermined timbre is assigned to the note selected for the timbre.

12. The tone generation assigning apparatus according to claim 7, wherein the processor is configured to select, for each of the predetermined timbres, at least one note from among the specified performance note and the generated one or more additional notes according to a number and a tone pitch order thereof, and wherein each predetermined timbre is assigned to the note selected for the timbre.

13. A tone generation assigning method for execution in a tone generation assigning apparatus, the method comprising:

detecting, by detection circuitry, an operation by a user on a single user-operable performance control to specify a performance note to be sounded according to the operation by the user;

generating, by a processor, one or more additional notes automatically; and assigning, by the processor, predetermined plural timbres to the specified performance note and the generated one or more additional notes, according to pitches of the specified performance note and the generated one or more additional notes, wherein each of the assigned plural timbres is respectively assigned to at least one note from among the specified performance note and the generated one or more additional notes according to tone pitch order or a note-on timing order thereof; and generating, by tone generator circuitry, audio signals representing musical tone waveforms of the specified performance note and the generated one or more additional notes in their assigned timbres, the generated audio signals to be sounded from a speaker.

* * * * *